US011434677B2

(12) United States Patent
Nuss

(10) Patent No.: US 11,434,677 B2
(45) Date of Patent: Sep. 6, 2022

(54) FREEZER WITH RELEASABLE DOOR HINGES

(71) Applicant: Haier US Appliance Solutions, Inc., Wilmington, DE (US)

(72) Inventor: Bart Andrew Nuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 559 days.

(21) Appl. No.: 16/520,691

(22) Filed: Jul. 24, 2019

(65) Prior Publication Data

US 2021/0025207 A1 Jan. 28, 2021

(51) Int. Cl.

| | |
|---|---|
| ***E05D 7/10*** | (2006.01) |
| ***F25D 23/02*** | (2006.01) |
| ***E05D 3/12*** | (2006.01) |
| ***E05D 5/14*** | (2006.01) |
| ***E05D 3/18*** | (2006.01) |

(52) U.S. Cl.

CPC ..... *E05D 7/1061* (2013.01); *E05D 3/12* (2013.01); *E05D 3/18* (2013.01); *E05D 5/14* (2013.01); *F25D 23/028* (2013.01); *E05Y 2900/31* (2013.01); *F25D 2323/024* (2013.01); *F25D 2331/804* (2013.01)

(58) Field of Classification Search

CPC .. E05D 3/18; E05F 1/12; E05F 1/1446; E05F 1/1253; E05F 1/1261; E05F 1/1269; E05F 1/1276; F25D 23/026; F25D 2323/024

USPC ..... 16/357, 358, 359, 360, 361, 362, 365, 16/286, 287, 289, 290

See application file for complete search history.

(56) References Cited

U.S. PATENT DOCUMENTS

| | | | | |
|---|---|---|---|---|
| 2,641,019 A * | 6/1953 | Burke | E05F 1/1261 16/85 |
| 2,893,772 A | 7/1959 | Edwards | |
| 2,911,667 A * | 11/1959 | Burke | E05F 1/1261 16/290 |
| 3,256,554 A * | 6/1966 | Turner | E05F 1/1261 16/273 |
| 3,457,584 A * | 7/1969 | Phelps | E05F 1/1261 16/290 |
| 3,690,708 A | 9/1972 | Worley et al. | |
| 9,918,547 B2 | 3/2018 | Wilmes et al. | |
| 2004/0211211 A1 * | 10/2004 | Nam | E05F 1/1215 16/284 |

(Continued)

FOREIGN PATENT DOCUMENTS

| | | | |
|---|---|---|---|
| CN | 206973992 U | 2/2018 | |
| EP | 2703590 A2 * | 3/2014 | E05F 1/12 |

(Continued)

*Primary Examiner* — Daniel J Rohrhoff

(74) *Attorney, Agent, or Firm* — Dority & Manning, P.A.

(57) ABSTRACT

A freezer appliance includes a cabinet defining a food storage chamber. A door is positioned on the cabinet and is movable between a closed position and an open position. The door is rotatably and releasably coupled to the cabinet by a hinge. The hinge includes a first hinge arm fixed to one of the door or the cabinet, a second hinge arm pivotably joined with the first hinge arm, and a carrier fixed to the other of the door or the cabinet. The second hinge arm is releasably received in the carrier, such that the door is detachable from the cabinet.

20 Claims, 8 Drawing Sheets

(56) References Cited

U.S. PATENT DOCUMENTS

| | | | | |
|---|---|---|---|---|
| 2005/0283948 | A1* | 12/2005 | Hyde | E05D 7/1061<br>16/361 |
| 2018/0180344 | A1* | 6/2018 | Takahashi | F25D 11/04 |
| 2021/0364222 | A1* | 11/2021 | Bischof | F25D 23/02 |

FOREIGN PATENT DOCUMENTS

| | | | | |
|---|---|---|---|---|
| EP | 3722546 | A1 * | 10/2020 | |
| WO | WO-2018109130 | A1 * | 6/2018 | E05F 1/1261 |

* cited by examiner

FREEZER WITH RELEASABLE DOOR HINGES

FIELD OF THE INVENTION

The subject matter of the present disclosure relates generally to appliances having a cabinet and a door. For example, such appliances may include freezer appliances.

BACKGROUND OF THE INVENTION

Freezer appliances generally include a cabinet that defines one or more chilled chambers for receipt of food items for storage. One or more insulated, sealing doors are provided for selectively enclosing the chilled food storage chamber (s). Generally, the door(s) are movable between a closed position and an open position for accessing food items stored therein by pulling on the door(s), such as by pulling on a handle on the door.

The freezer door is generally rotatably mounted to the cabinet using one or more hinges, which are typically fixed to the cabinet and the door. In some instances, such doors may be cumbersome or inconvenient to operate. For example, the door may be inconvenient to open if the handle breaks and/or if the door is particularly heavy. The weight of the door may be of particular concern when the door opens vertically, e.g., when the door rotates about a horizontal (e.g., lateral or transverse) axis, such that the opening motion is against the force of gravity. In other instances, it may be desirable to conveniently and non-destructively remove the door from the cabinet, e.g., for maintenance or repairs to the door and/or other components of the freezer.

Accordingly, a freezer appliance having an improved means for opening a door thereof would be useful. In particular, a freezer appliance having a means for opening a door other than by rotating about a fixed hinge would be desirable.

BRIEF DESCRIPTION OF THE INVENTION

Aspects and advantages of the invention will be set forth in part in the following description, or may be apparent from the description, or may be learned through practice of the invention.

In a first exemplary embodiment, a freezer appliance is provided. The freezer appliance defines a vertical direction, a lateral direction, and a transverse direction. The vertical, lateral, and transverse directions are mutually perpendicular. The freezer appliance includes a cabinet defining a food storage chamber. The food storage chamber includes a top portion along the vertical direction. The top portion of the food storage chamber defines an opening for receipt of food items. A door is positioned at the top portion of the food storage chamber and is movable between a closed position and an open position. The door thus selectively sealingly encloses the food storage chamber in the closed position and provides access to the food storage chamber in the open position. The door is rotatably coupled to the cabinet by a hinge. The hinge includes a first hinge arm fixed to one of the door or the cabinet, a second hinge arm pivotably joined with the first hinge arm, and a carrier fixed to the other of the door or the cabinet. The second hinge arm is releasably received in the carrier, such that the door is detachable from the cabinet.

In a second exemplary embodiment, hinge for a freezer appliance is provided. The freezer appliance defines a vertical direction, a lateral direction, and a transverse direction.

The vertical, lateral, and transverse directions are mutually perpendicular. The freezer appliance includes a cabinet and a door. The hinge rotatably couples the door to the cabinet. The hinge includes a first hinge arm fixed to one of the door or the cabinet, a second hinge arm pivotably joined with the first hinge arm, and a carrier fixed to the other of the door or the cabinet. The second hinge arm is releasably received in the carrier, such that the door is detachable from the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
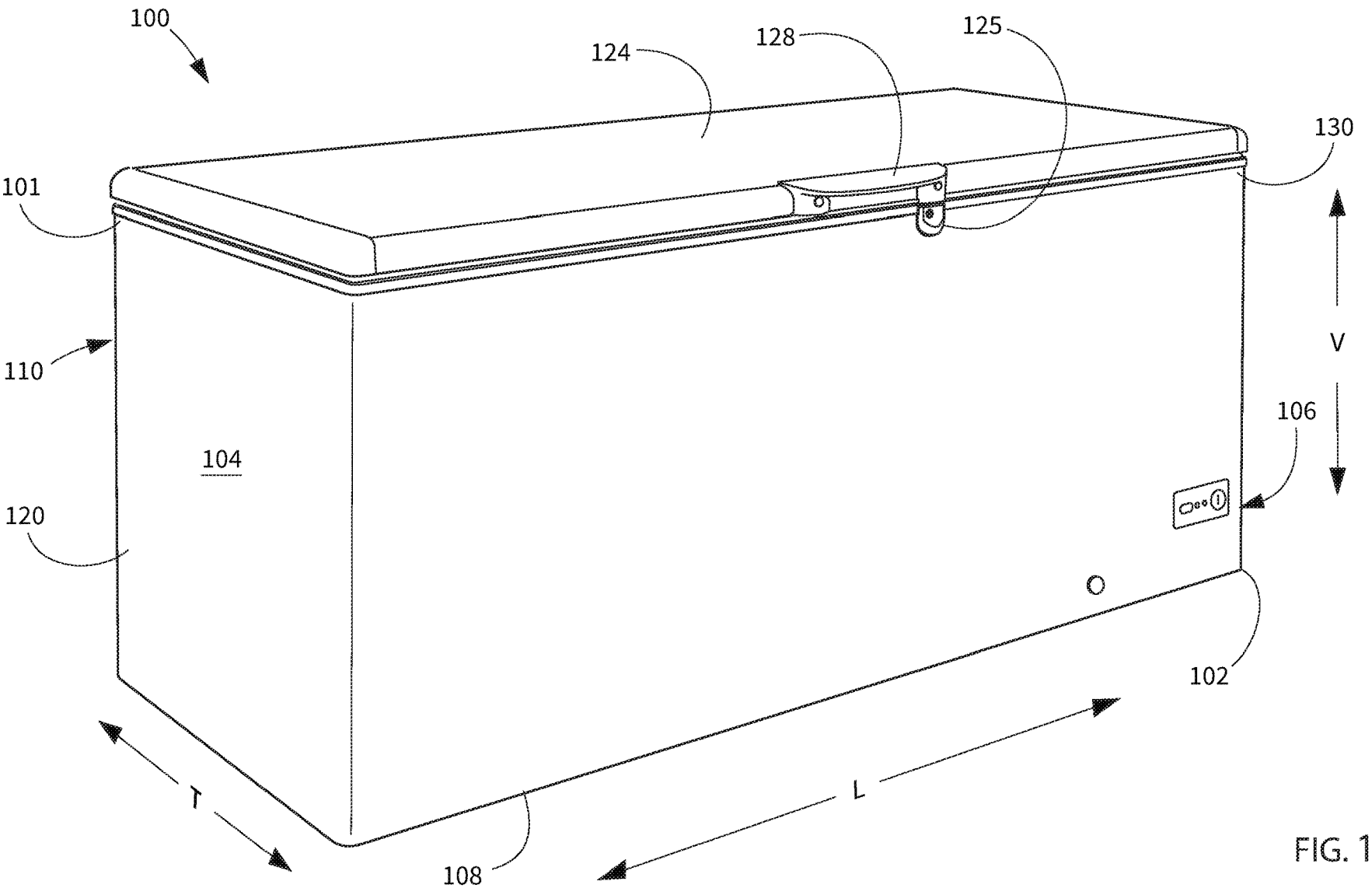
FIG. 1 provides a perspective view of a freezer appliance according to an exemplary embodiment of the present subject matter with a door of the appliance shown in the closed position.

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the freezer appliance, and in particular the food storage chamber(s) defined therein. For example, "inner" or "inward" refers to the direction towards the interior of the freezer appliance. Terms such as "left," "right," "front," "back," "top," or "bottom" are used with reference to the perspective of a user accessing the freezer appliance. For example, a user stands in front of the freezer to open the door(s) and reaches into the food storage chamber(s) to access items therein.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
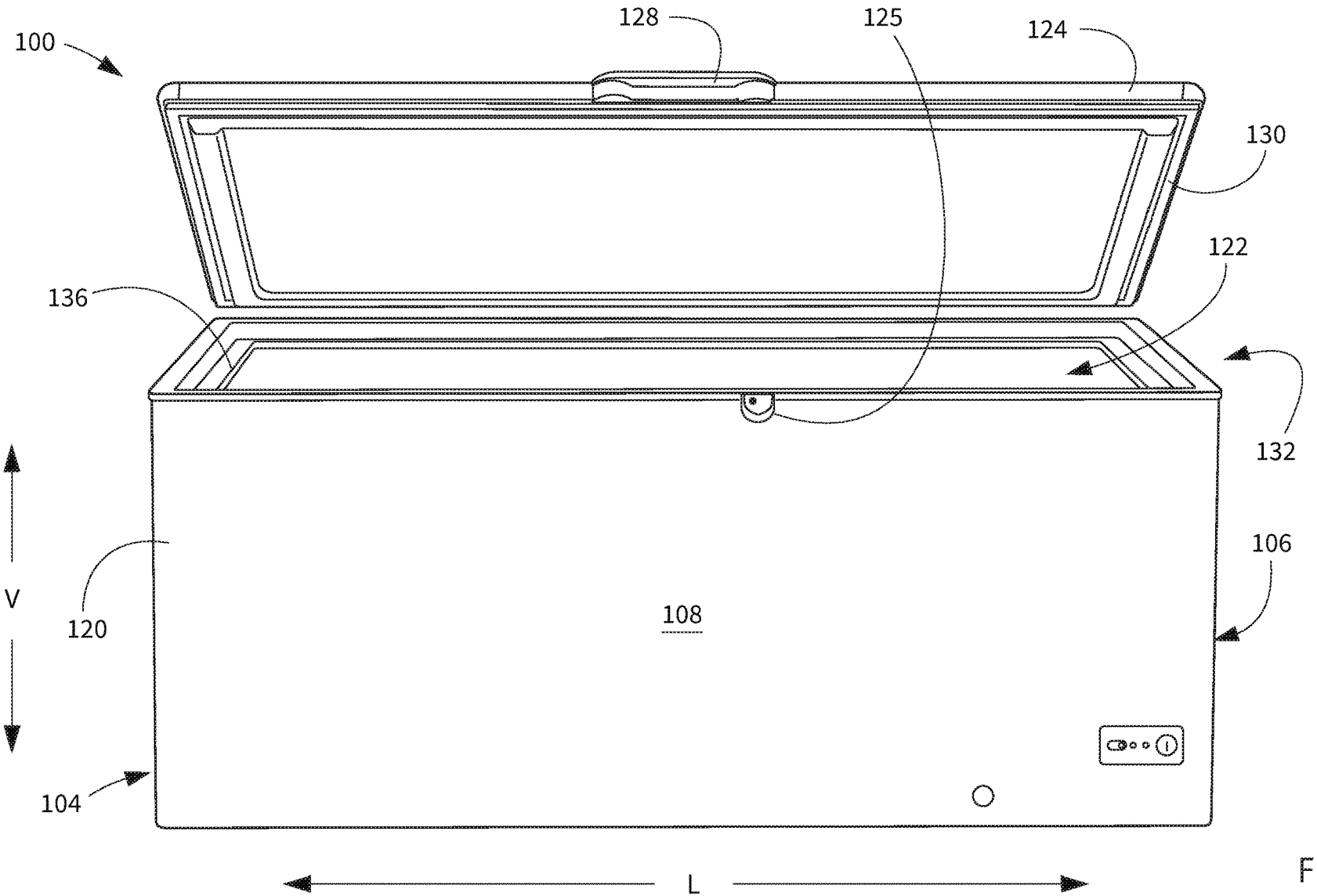
FIG. 2 provides a front elevation view of the exemplary freezer appliance of FIG. 1 with the door shown in an open position.

As illustrated in FIGS. 1 and 2, an exemplary freezer appliance 100 has an insulated housing or cabinet 120 that defines a food storage chamber 122. A door 124 is provided to selectively sealingly enclose the food storage chamber 122 when in a closed position (FIG. 1) and provide access to the food storage chamber 122 when in an open position (FIG. 2). The door 124 is rotatably mounted to the cabinet 120, such as by one or more hinges 200 (FIGS. 3-6), to rotate between the open position and the closed position. The freezer appliance 100 may include a handle 128 on the door 124 to promote opening and closing the door 124. In at least some embodiments, the freezer appliance 100 may also include a latch 125 which holds the door 124 in the closed position, e.g., the latch 125 may prevent opening of the door 124 from the inside (e.g., within food storage chamber 122) of the cabinet 120.

Freezer appliance 100 defines a vertical direction V, a lateral direction L, and a transverse direction T (FIG. 1), each mutually perpendicular to one another. As may be seen in FIGS. 1 and 2, the cabinet or housing 120 extends between a top 101 and a bottom 102 along the vertical direction V, between a left side 104 and a right side 106 along the lateral direction L, and between a front 108 and a rear 110 along the transverse direction T. As may be seen in FIG. 2, the food storage chamber 122 includes a top portion 132 (e.g., at or near an uppermost position on the food storage chamber 122 along the vertical direction V, such as at or near the top 101 of the cabinet 120). The top portion 132 of the food storage chamber 122 defines an opening 136 for receipt of food items. The food storage chamber 122 is a chilled chamber 122 for receipt of food items for storage. As used herein, the chamber may be "chilled" in that the chamber is operable at temperatures below room temperature, e.g., less than about seventy-five degrees Fahrenheit (75° F.). In at least some embodiments, the appliance 100 may be a freezer appliance which is operable at temperatures between about zero degrees Fahrenheit (0° F.) and about thirty degrees Fahrenheit (30° F.). One of ordinary skill in the art will recognize that the food storage chamber 122 may be chilled by a sealed refrigeration system, such that the food storage chamber 122 may be operable at or about the temperatures described herein by providing chilled air from the sealed system. The structure and function of such sealed systems are understood by those of ordinary skill in the art and are not described in further detail herein for the sake of brevity and clarity.

Freezer door 124 is rotatably mounted, e.g., hinged, to an edge of cabinet 120 for selectively accessing the food storage chamber 122 within the cabinet 120. Freezer door 124 may be mounted to the cabinet 120 at or near the top portion 132 of the food storage chamber 122 such that the door 124 moves, e.g., rotates via hinges 200 (FIGS. 3-6), between the closed position (FIG. 1) and the open position (FIG. 2). In the open position of FIG. 2, the door 124 permits access to the fresh food storage chamber 122. In the closed position of FIG. 1, the door 124 sealingly encloses the food storage chamber 122. Additionally, one or more gaskets 130 and other sealing devices may be provided to promote sealing between the door 124 and the cabinet 120. In the illustrated example embodiments, the gasket 130 is mounted on the door 124, whereas in other exemplary embodiments the gasket 130 may also or instead be mounted on the cabinet 120.

As depicted, cabinet 120 defines a single chilled chamber 122 for receipt of food items for storage. In some embodiments, the freezer appliance 100 may include one or more additional chilled chambers for receipt of various food items and storage of such items at various temperatures as desired. For example, the freezer appliance 100 may include one or more chilled chambers configured for deep freeze (e.g., at about 0° F. or less) storage, or configured for chilling, e.g., produce or wine, at relatively warmer temperatures such as about 60° F. or more, as well as any suitable temperatures between the stated examples. In various exemplary embodiments, the chilled chamber 122 may be selectively operable at any number of various temperatures and/or temperature ranges as desired or required per application, and/or the freezer appliance 100 may include one or more additional chambers selectively operable at any suitable food storage temperature.

The illustrated exemplary freezer appliance 100 is generally referred to as a standalone freezer or chest freezer. It is recognized, however, that the benefits of the present disclosure apply to other types and styles of appliances such as, for example, a refrigerator appliance. Consequently, the description set forth herein is for illustrative purposes only and is not intended to be limiting in any aspect to a particular storage chamber configuration or orientation.

As may be seen in FIGS. 3 through 6, the door 124 of the freezer appliance 100 may be rotatably and releasably coupled to the cabinet 120 by one or more hinges 200. As will be described in more detail below, the door 124 may be released and/or detached from the cabinet 120 by separating the hinge 200, e.g., by separating a second hinge arm 204 from a carrier 206 of the hinge 200. It may be desirable for the door 124 to be released or detached from the cabinet 120 by separating the hinge 200 if, for example, the handle 128 breaks or the latch 125 becomes stuck. In at least some embodiments, the door 124 may be released and/or detached from the cabinet 120 from the inside or the outside of the appliance 100, e.g., by pulling up on the door 124 from the outside of the appliance 100 or by pushing up and out on the door 124 from within the appliance 100, such as from within the food storage chamber 122.

The hinge 200 may include a first hinge arm 202 fixed to one of the door 124 or the cabinet 120, e.g., fixed to the door 124 as in the examples illustrated in FIGS. 3-6. It should be understood that the first hinge arm 202 may be "fixed" to the door 124 (or cabinet 120, in other embodiments) in that the first hinge arm 202 does not move relative to the door 124 during the ordinary and intended operation (e.g., when opening and/or closing the door 124) of the freezer appliance 100, e.g., without undoing the fixed connection between the first hinge arm 202 of the hinge 200 and the door 124. For example, the first hinge arm 202 may be fixed to the door 124 with one or more fasteners such as, but not limited to, rivets, bolts, and/or screws, and the first hinge arm 202 may be also or instead be fixed to the door 124 by, e.g., welding or soldering. The hinge 200 may also include a second hinge arm 204. The second hinge arm 204 may be pivotably joined with the first hinge arm 202, such as by a pivot 203. The hinge 200 may further include a carrier 206 fixed to the other of the door 124 or the cabinet 120, e.g., fixed to the cabinet 120 as in the illustrated example. It should be understood that the carrier 206 is "fixed" to the cabinet 120 in the same sense that the first hinge arm 202 is "fixed" to the door 124, e.g., the carrier 206 does not move relative to the cabinet 120 in the ordinary and intended operation of the freezer appliance 100, etc., as described above.

Figure 3:
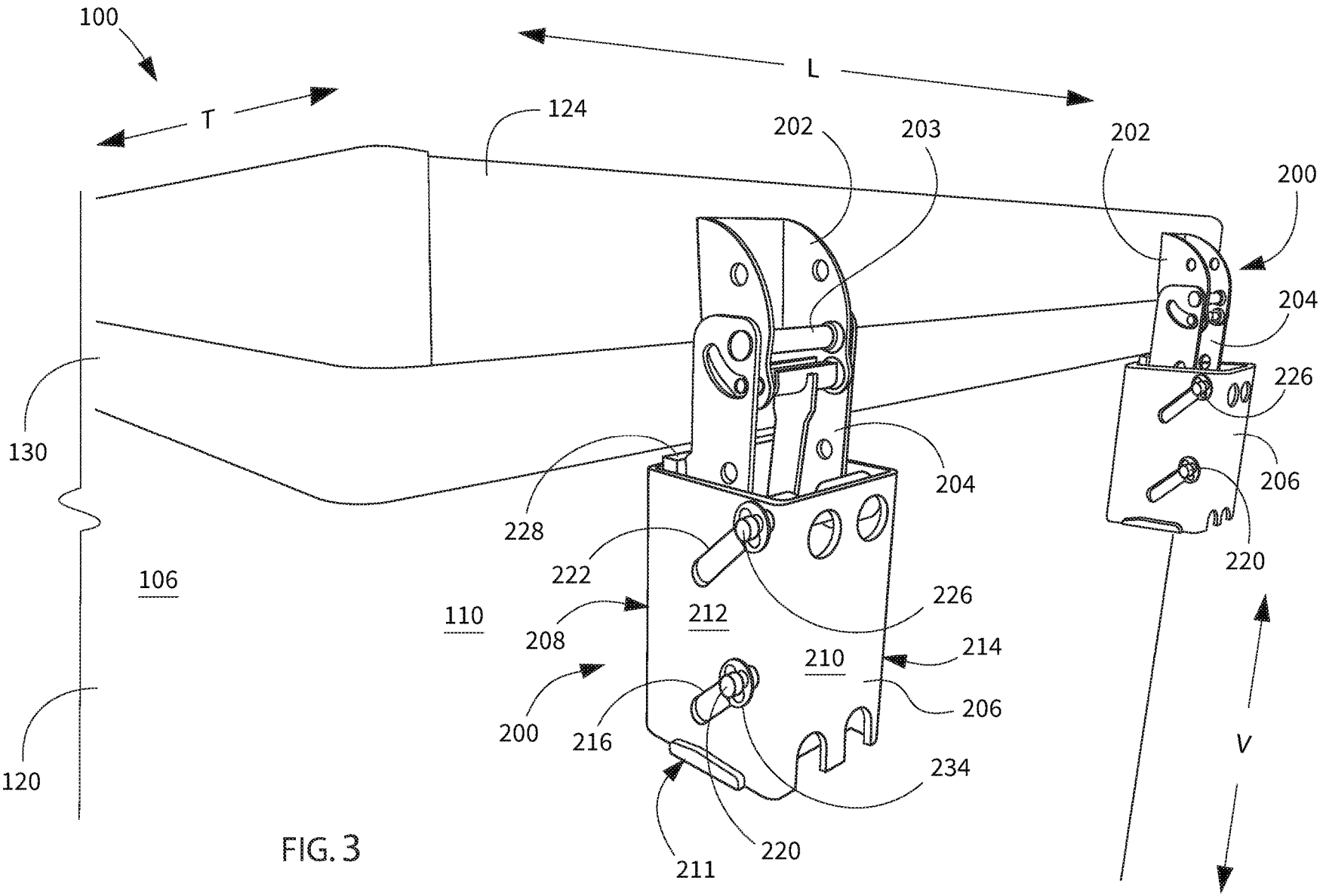
FIG. 3 provides a rear perspective view of the exemplary freezer appliance of FIG. 1.

Turning specifically to FIG. 3, the example hinge 200 is illustrated in an attached position where the second hinge arm 204 is received within the carrier 206. In particular, the second hinge arm 204 is received within the carrier and held within the carrier by a first pin 220 and a second pin 226. When positioned as illustrated in FIG. 3, e.g., when the door 124 is in the closed position and the hinge 200 is in the attached position (e.g., the second hinge arm 204 is received within the carrier 206), the door 124 sealingly encloses the food storage chamber 122, such as though sealing engagement with the gasket 130. As illustrated in FIG. 3, the first pin 220 and the second pin 226 are each in an upper position, wherein the pins 220 and 226 wedge the second hinge arm 204 forward along the transverse direction T, providing an interference fit between the second hinge arm 204 and the carrier 206, e.g., the between the second hinge arm 205 and the pins 220, 226 within the carrier 206. With the hinge 200 in the attached position, e.g., when the second hinge arm 204 is received within the carrier 206 and is held in the carrier 206 by the pins 200 and 226, the door 124 may rotate relative to the cabinet 120, e.g., between the closed position (FIGS. 1 and 3) and the open position (FIG. 2). Also, when the hinge 200 is in the attached position, the second hinge arm 204 may be vertically supported by a bottom wall 211 (best seen in FIG. 8) of the carrier 206.

As may be seen in FIGS. 3 through 8, the carrier 206 may include a front wall 208 fixed to the other of the door 124 or the cabinet 120, e.g., fixed to the cabinet 120 as in the illustrated example embodiments. The carrier 206 may also include a rear wall 210 opposite the front wall 208, e.g., along the transverse direction T, with a first side wall 212 extending between the front wall 208 and the rear wall 210 and a second side wall 214 extending between the front wall 208 and the rear wall 210 opposite the first side wall 212 along the lateral direction L. The first pin 220 may extend through a first slot 216 formed in the first side wall 212 and a second slot 218 (FIG. 8) formed in the second side wall 214, e.g., the first pin 220 may extend generally along the lateral direction L. The second pin 226 may be spaced apart from, e.g., above, the first pin 220 along the vertical direction V. The second pin 226 may extend through a third slot 222 formed in the first side wall 212 and a fourth slot 224 (FIG. 7) formed in the second side wall 214, e.g., the second pin 226 may extend generally parallel to the first pin 200 and/or along the lateral direction L. In some embodiments, only one of the first pin 220 and the second pin 226 may be provided. In other embodiments, both pins 220 and 226 may be included, as illustrated.

The first slot 216 and the second slot 218 may be mutually parallel to each other, and may be oblique to the vertical direction V. For example, the slots 216 and 218 may be oriented predominantly or generally within a vertical-transverse plane defined by the vertical direction V and the transverse direction T and the slots 216 and 218 may be oblique to each of the vertical and transverse directions V and T. For example, the first slot 216 and the second slot 218 may be oriented at an angle of between about twenty degrees (20°) and about eighty degrees (80°) with respect to the vertical direction V, such as between about thirty degrees (30°) and about sixty degrees (60°), such as about forty-five degrees (45°) with respect to the vertical direction V. Similarly, the third slot 222 and fourth slot 224 may be mutually parallel to each other and may be oblique to the vertical direction V at any of the angles described herein. In embodiments where the third slot 222 and fourth slot 224 are included in combination with the first slot 216 and the second slot 218, the third slot 222 and fourth slot 224 may be parallel to the first slot 216 and the second slot 218 or may be oriented at a different angle with respect to the vertical direction V (within the stated ranges) than the first slot 216 and the second slot 218. Thus, as will be described in more detail below, the pin(s) 220 and/or 226 may travel within the respective slot(s) 216, 218 and/or 222, 224 between the upper position (e.g., as described above with reference to FIG. 3, where both pins 220 and 226 are in the upper position) and a lower position by gravity.

Figure 4:
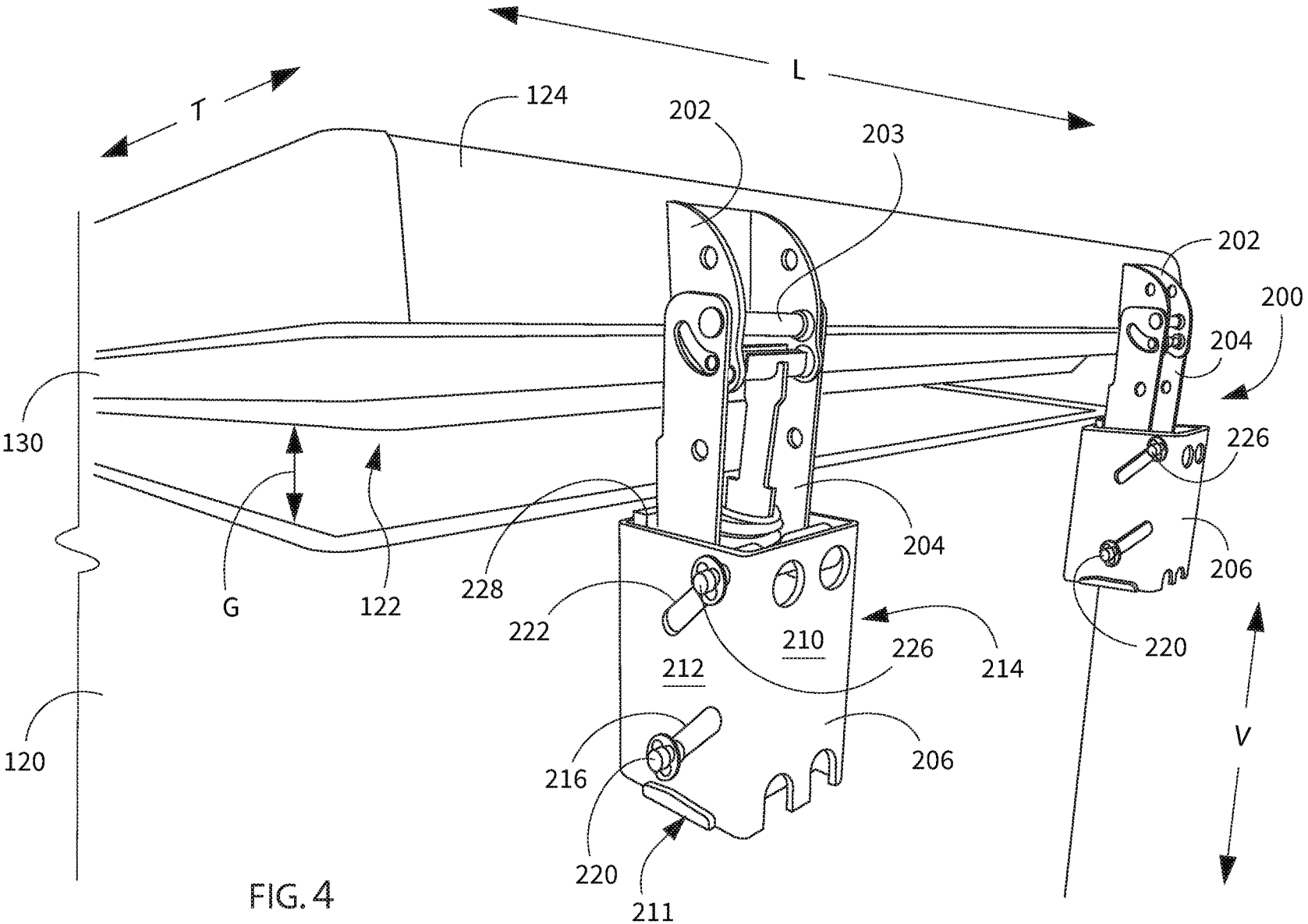
FIG. 4 provides a rear perspective view of the exemplary freezer appliance of FIG. 1 with hinges thereof in a first released position.
Figure 5:
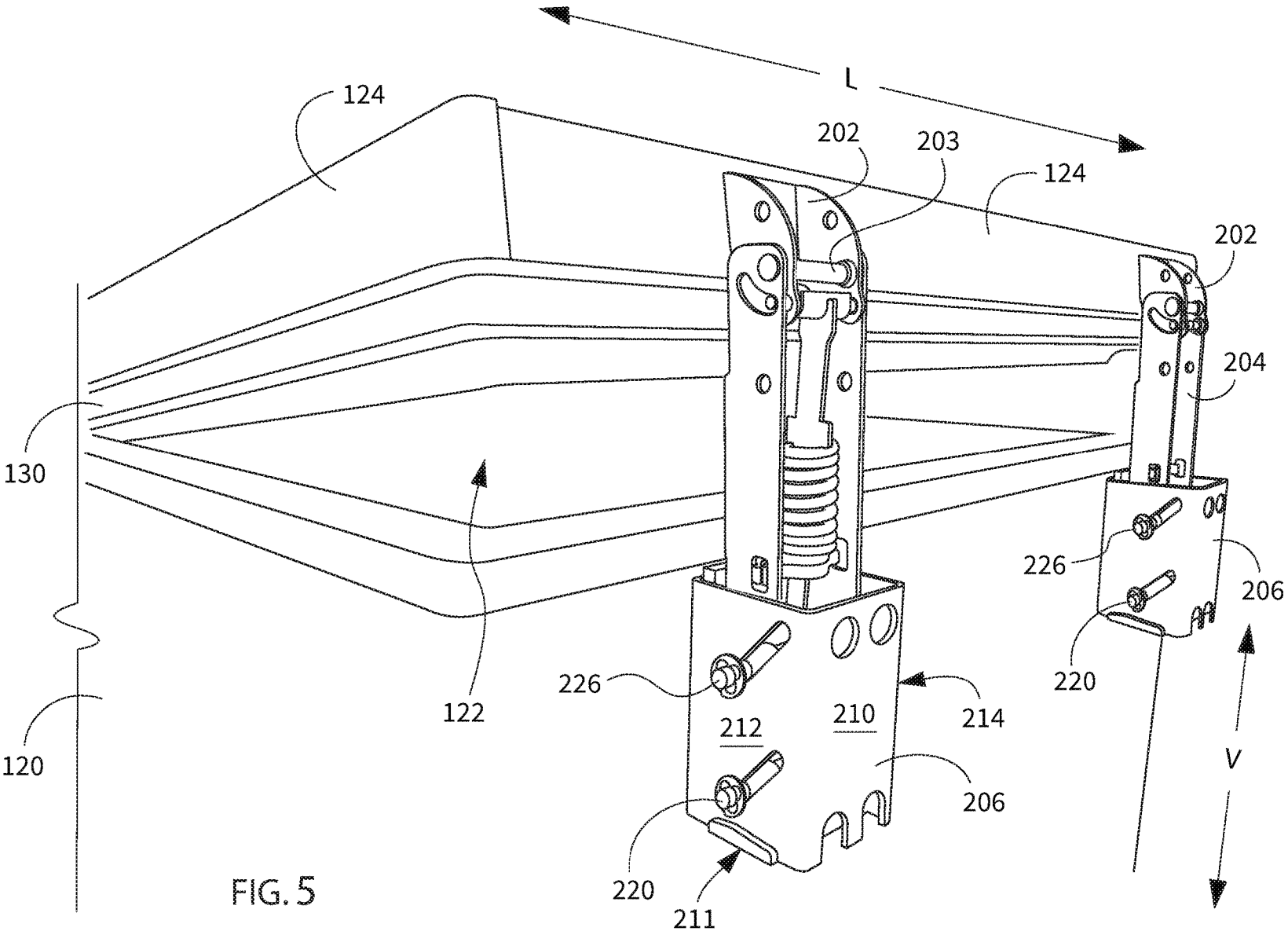
FIG. 5 provides a rear perspective view of the exemplary freezer appliance of FIG. 1 with the hinges in a second released position.

Turning specifically to FIGS. 4 and 5, in some embodiments, the hinge 200 may provide a staged release. For example, the hinge 200 may be movable from the attached position (described above with respect to FIG. 3) to a first released position as shown in FIG. 4, and from the first released position of FIG. 4 to a second released position as shown in FIG. 5. As shown in FIG. 4, application of a force to the door 124 in an upward (along the vertical direction V) and/or outward (e.g., away from/out of the food storage chamber 122) direction at a point near the hinges 200 may push the door 124 and hinge (or hinges, as in the illustrated example embodiment) 200 to a first released position where the second arm 204 of the hinge 200 passes above the first pin 220, causing the pin 220 to release the wedging interference fit between the pin 220/carrier 206 and the second hinge arm 204. When the first pin 220 is disengaged from the second hinge arm 204, the first pin 220 travels, e.g., slides and/or rolls, within the first slot 216 and second slot 218 to the lower position at the bottom of the slots 216 and 218 under the force of gravity. In this position, e.g., the first released position, the pin 220 may support the second hinge arm 204 along the vertical direction V. Accordingly, the first pin 220 may also serve to retain the hinge 200 in the first released position by preventing the second hinge arm 204 from falling back into place within the carrier 206 until the first pin 220 is reset. For example, the first pin 220 may be reset by a user lifting the door 124 such that the second arm 204 of the hinge 200 is not resting on the first pin 220 and then manually moving the first pin 220 back to the upper position (FIG. 3) within the slots 216 and 218. The door 124 may be spaced apart from the opening 136 (FIG. 2), such as by a gap G as illustrated in FIG. 4, when the second hinge arm 204 is supported on the first pin 220. The first released position, e.g., as illustrated in FIG. 4, may be an intermediate position, such as with the first pin 220 in the lower position while the second pin 226 remains in the upper position.

Continued or additional application of upward/outward force on the door 124 may move the hinges 200 from the first released position, e.g., as illustrated in FIG. 4, to the second released position, e.g., as illustrated in FIG. 5. As may be seen in FIG. 5, when the hinge 200 is in the second released position, both the first pin 220 and the second pin 226 are in the lower position. Additionally, the second arm 204 of the hinge 200 may be supported on the second pin 226 when in the second released position. As described above with respect to the first pin 220 in the first released position, the second pin 226 may hold the hinge 200 in the second released position, e.g., may prevent the second hinge arm 204 from falling back into the carrier 206 from the second released position. When the hinge 200 is in the second released position, the door 124 may be spaced apart from the opening 236 of the food storage chamber 122 by a second distance greater than the gap distance G illustrated in FIG. 4 along the vertical direction V.

Figure 6:
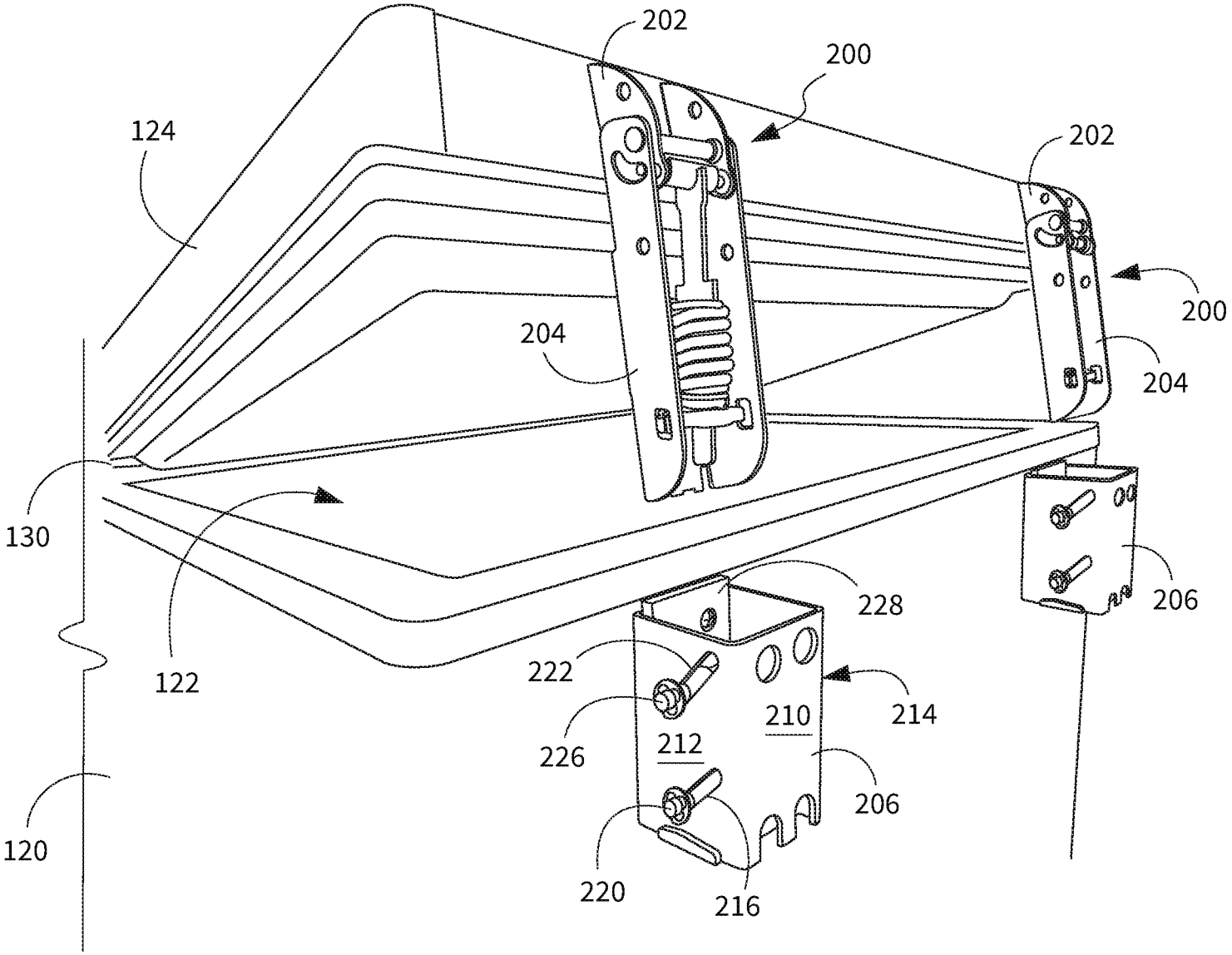
FIG. 6 provides a rear perspective view of the exemplary freezer appliance of FIG. 1 with the hinges in a detached position.

In at least some embodiments, the hinge 200 may be separated subsequent to moving the hinge 200 to the first released position and the second released position, e.g., the second hinge arm 204 may be entirely removed from the carrier 206 such that the hinge 200 is in a detached position, e.g., the door 124 may be lifted completely off of the cabinet 120 from the released position (e.g., in embodiments with a single pin) and/or from the second released position, e.g., in embodiments such as the example illustrated in FIG. 6 where a first pin 220 and a second pin 226 are both provided, to the detached position illustrated in FIG. 6.

Figure 7:
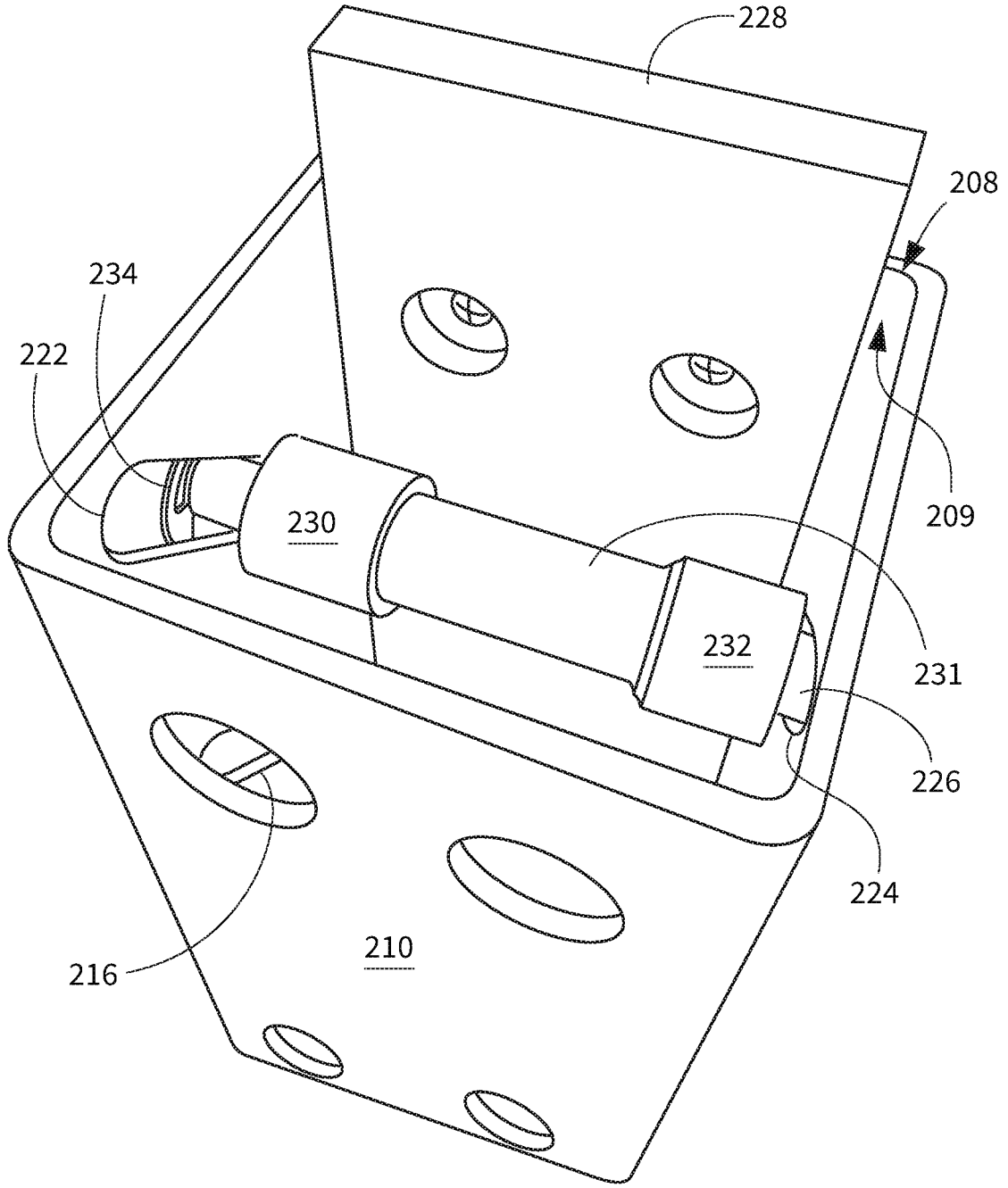
FIG. 7 provides a top-down perspective view of an exemplary carrier for a hinge, which may be incorporated into an appliance such as the freezer appliance of FIG. 1.

FIG. 7 provides a top-down perspective view of an exemplary carrier 206 of a hinge 200. As may be seen in FIG. 7, the second pin 226 may extend between the third slot 222 in the first sidewall 212 of the carrier 206 and the fourth slot 224 in the second sidewall 214 of the carrier 206 and the second pin 226 may be retained within the slots 222 and 224 by a flange or collar 234 at each end of the pin 226. In some embodiments, such as the illustrated example embodiment in FIG. 7, the collar 234 may be provided as a clip removably attached to the ends of the pin 226. In other embodiments, the collar 234 may, for example, be provided as a flange integrally formed with the pin 226 instead of or in addition to the clip (e.g., in some embodiments, an integral flange may be provided at one end of the pin 226 and a clip may be provided at the other end of the pin 226).

Also as may be seen in FIG. 7, in some embodiments, the carrier 206 may include a wear pad 228 on an internal surface 209 of the front wall 208 of the carrier 206. For example, the internal surface 209 may be internal to the carrier 206, e.g., the internal surface 209 may face the interior of the carrier 206, such as the internal surface 209 may be the surface of the front wall 208 opposite the cabinet 120 and opposite an outer surface of the front wall 208 which abuts the cabinet 120.

In at least some embodiments, one or more rollers, as illustrated for example in FIG. 7, may be provided on the pin 226. For example, a roller 231 may be provided on the pin 226 within the carrier 206. The roller 231 may include a first enlarged end 230 on one side of the pin 226 (e.g., inside of and proximate the first sidewall 212) and a second enlarged end 232 on the other side of the pin 226 (e.g., inside of and proximate the second sidewall 214). The roller 231 (including the enlarged ends 230, 232 thereof) may be formed of any suitable durable, low-friction material. For example, the roller 231 may be formed of a plastic material, such as nylon or tetrafluoroethylene ("TEFLON"). The wear pad 228 may also be formed of the same material as the rollers 230 and 232 or a similar material. The roller 231 may be movable relative to the pin 226, e.g., the roller 231 may be rotatable around the pin 226. Thus, the roller 231 may promote ease of movement of the hinge 200 between the various positions described above, e.g., between the attached position and the released position (such as the first and/or second released position) and/or between the released position(s) and the detached position.

Figure 8:
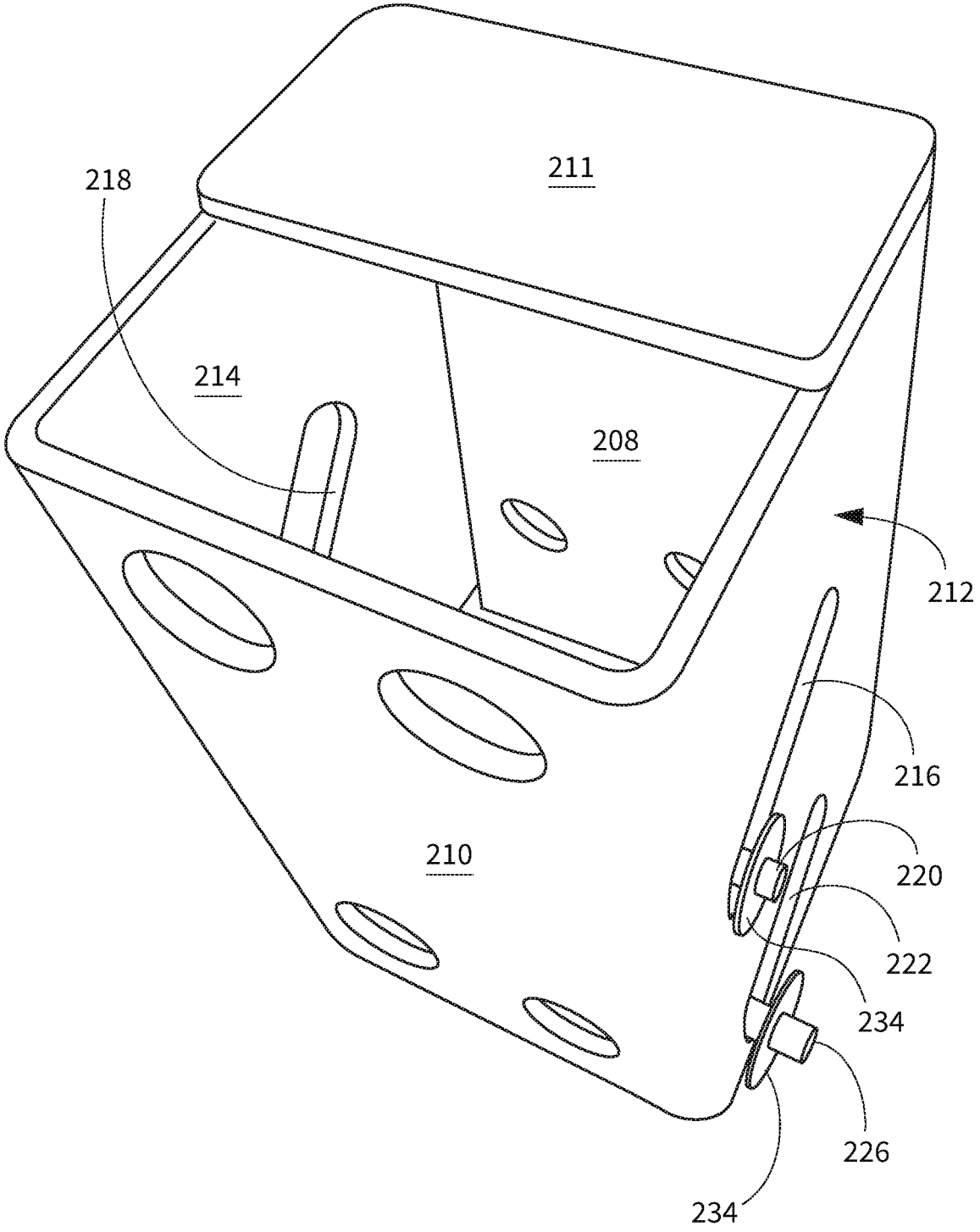
FIG. 8 provides a bottom-up perspective view of the carrier of FIG. 7.

FIG. 8 provides a bottom-up perspective view of the exemplary carrier 206 for a detachable hinge 200. The bottom wall 211 of the carrier 206 is best seen in FIG. 8. Additionally, the first slot 216, second slot 218, and the first pin 220 extending therebetween may be seen in FIG. 8. As illustrated in FIG. 8, the first pin 220 may also include a collar 234 at each end, similar to the collar 234 described above with respect to the second pin 226 in the context of FIG. 7. Only one collar 234 is illustrated for example in FIG. 8, while the other collar 234 on the first pin 220 may be generally the same as the collar 234 shown in FIG. 8 or one or both of the collars 234 on the second pin 226 as shown in FIG. 7 and described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A freezer appliance defining a vertical direction, a lateral direction, and a transverse direction, the vertical, lateral, and transverse directions being mutually perpendicular, the freezer appliance comprising:

a cabinet defining a food storage chamber, the food storage chamber comprising a top portion, the top portion of the food storage chamber defining an opening for receipt of food items;

a door positioned at the top portion of the food storage chamber and movable between a closed position and an open position to selectively sealingly enclose the food storage chamber in the closed position and provide access to the food storage chamber in the open position; and a hinge rotatably coupling the door to the cabinet, the hinge comprising:

a first hinge arm fixed to one of the door or the cabinet;

a second hinge arm pivotably joined with the first hinge arm; and a carrier fixed to the other of the door or the cabinet, the second hinge arm releasably received in the carrier, whereby the door is detachable from the cabinet.

2. The freezer appliance of claim 1, wherein the first hinge arm is fixed to the door and the carrier is fixed to the cabinet.

3. The freezer appliance of claim 1, wherein the carrier comprises a front wall fixed to the other of the door or the cabinet, a rear wall opposite the front wall, a first side wall extending between the front wall and the rear wall, a second side wall extending between the front wall and the rear wall opposite the first side wall along the lateral direction, a first slot formed in the first side wall and a second slot formed in the second side wall, wherein the second hinge arm is releasably held in the carrier by a pin extending through the first slot and the second slot.

4. The freezer appliance of claim 3, wherein the carrier further comprises a bottom wall.

5. The freezer appliance of claim 3, wherein the first slot and the second slot are mutually parallel and are oblique to the vertical direction.

6. The freezer appliance of claim 3, wherein the first slot and the second slot are oriented at an angle of about forty-five degrees with respect to the vertical direction.

7. The freezer appliance of claim 3, further comprising a third slot formed in the first side wall, a fourth slot formed in the second side wall, wherein the pin is a first pin and wherein the second hinge arm is releasably held in the carrier by the first pin extending through the first slot and the second slot and a second pin extending through the third slot and the fourth slot.

8. The freezer appliance of claim 3, wherein the pin is movable within the first slot and the second slot from an upper position where the pin provides an interference fit along the transverse direction between the second hinge arm and the carrier and a lower position where the pin supports the second hinge arm along the vertical direction.

9. The freezer appliance of claim 8, wherein the door sealingly encloses the food storage chamber when the door is in the closed position and the second hinge arm is received within the carrier while the pin is in the upper position and wherein the door is spaced apart from the opening of the food storage chamber when the second hinge arm is supported on the pin along the vertical direction.

10. The freezer appliance of claim 3, wherein the carrier further comprises a wear pad on an internal surface of the front wall opposite the cabinet and further comprising a roller on the pin.

11. A hinge for a freezer appliance, the freezer appliance defining a vertical direction, a lateral direction, and a transverse direction, the vertical, lateral, and transverse directions being mutually perpendicular, the freezer appliance comprising a cabinet and a door, the hinge rotatably coupling the door to the cabinet, the hinge comprising:

a first hinge arm fixed to one of the door or the cabinet;

a second hinge arm pivotably joined with the first hinge arm; and a carrier fixed to the other of the door or the cabinet, the second hinge arm releasably received in the carrier, whereby the door is detachable from the cabinet.

12. The hinge for a freezer appliance of claim 11, wherein the first hinge arm is fixed to the door and the carrier is fixed to the cabinet.

13. The hinge for a freezer appliance of claim 11, wherein the carrier comprises a front wall fixed to the other of the door or the cabinet, a rear wall opposite the front wall, a first side wall extending between the front wall and the rear wall, a second side wall extending between the front wall and the rear wall opposite the first side wall along the lateral direction, a first slot formed in the first side wall and a second slot formed in the second side wall, wherein the second hinge arm is releasably held in the carrier by a pin extending through the first slot and the second slot.

14. The hinge for a freezer appliance of claim 13, wherein the carrier further comprises a bottom wall.

15. The hinge for a freezer appliance of claim 13, wherein the first slot and the second slot are mutually parallel and are oblique to the vertical direction.

16. The hinge for a freezer appliance of claim 13, wherein the first slot and the second slot are oriented at an angle of about forty-five degrees with respect to the vertical direction.

17. The hinge for a freezer appliance of claim 13, further comprising a third slot formed in the first side wall, a fourth slot formed in the second side wall, wherein the pin is a first pin and wherein the second hinge arm is releasably held in the carrier by the first pin extending through the first slot and the second slot and a second pin extending through the third slot and the fourth slot.

18. The hinge for a freezer appliance of claim 13, wherein the pin is movable within the first slot and the second slot from an upper position where the pin provides an interference fit along the transverse direction between the second hinge arm and the carrier and a lower position where the pin supports the second hinge arm along the vertical direction.

19. The hinge for a freezer appliance of claim 18, wherein the door sealingly encloses the food storage chamber when the second hinge arm is received within the carrier and the pin is in the upper position and wherein the door is spaced apart from the opening of the food storage chamber when the second hinge arm is supported on the pin along the vertical direction.

20. The hinge for a freezer appliance of claim 13, wherein the carrier further comprises a wear pad on an internal surface of the front wall opposite the cabinet and further comprising a roller on the pin.

* * * * *